US005830005A

United States Patent [19]

Watanabe

[11] Patent Number: 5,830,005

[45] Date of Patent: Nov. 3, 1998

[54] MODULAR PLUG GUIDE PLATE

[75] Inventor: Toru Watanabe, Tokyo, Japan

[73] Assignee: Hirose Electric Co., Ltd., Tokyo, Japan

[21] Appl. No.: 783,448

[22] Filed: Jan. 16, 1997

[51] Int. Cl.[6] ..... H01R 4/24

[52] U.S. Cl. ..... 439/418; 439/676

[58] Field of Search ..... 439/418, 460, 439/676

[56] References Cited

U.S. PATENT DOCUMENTS 4,874,330 10/1989 Bogese, II et al. ..... 439/418
4,889,503 12/1989 Philippson et al. ..... 439/676
5,057,035 10/1991 Drewicki ..... 439/676
5,147,215 9/1992 Pritulsky ..... 439/676
5,577,930 11/1996 Dahlem et al. ..... 439/460

*Primary Examiner*—Hien Vu
*Assistant Examiner*—Tho Dac Ta
*Attorney, Agent, or Firm*—Kanesaka & Takeuchi

[57] ABSTRACT

A modular guide plate for a modular plug having an insulation housing with a receiving cavity includes an organizing section having a plurality of organizing apertures in which core wires of a cable are arranged and held closely in parallel and a plurality of terminal slits through which contact terminals are press-connected to the core wires and an introducing section extending rearwardly from the organizing section and having bottom and side walls for introducing the core wires into the organizing apertures.

5 Claims, 5 Drawing Sheets

MODULAR PLUG GUIDE PLATE

BACKGROUND OF THE INVENTION

1. Filed of the Invention

The present invention relates to modular plugs and, more particularly, to guide plates for modular plugs.

2. Description of the Related Art

Modular plugs are widely used to facilitate connection to and disconnection from communication lines of telephone sets or other electronic equipment. A variety of modular plug guide plates are used to facilitate connection of cables of electronic equipment to modular plugs. The guide plates are used mainly to organize core wires of a cable. A guide plate receiving cavity extends from the rear end to the front end of an insulation housing of a modular plug so as to receive a guide plate.

To connect a cable to a modular plug of this type, the sheath of a terminal end of the cable is removed, and the separated core wires are organized by a guide plate. The organized core wires are pushed into the guide plate receiving cavity until the guide plate reaches the front end of the guide plate receiving cavity. A contact terminal is then pushed down into the insulating housing so that it is press connected to the organized core wires.

FIG. 6 shows a conventional guide plate of this type. The modular plug guide plate 20 is molded from a plastic material to provide organizing apertures 21 which extend between the front and rear ends of the guide plate. A reinforcing beam 22 is provided at a middle of the organizing apertures 21. Terminal receiving slits 23 are provided on the upper wall of the organizing apertures 21 to receive contact terminals of the modular plug. Separation walls 24 are provided between the adjacent terminal receiving slits 23 to insulate the contact terminals from each other.

To connect a cable to the modular plug by using the guide plate 20, a predetermined length of sheath 11 is removed from the terminal end to expose core wires 12. The core wires 12 are separated and put into the corresponding organizing apertures 21. FIG. 7 shows how the guide plate 20 organizes and holds the core wires 12 of the cable 10. As FIG. 8 shows, guide plate 20 and the terminal end of the cable 10 are inserted into a receiving cavity 31 of the insulating housing 30. When the guide plate 20 reaches a predetermined front position, a contact terminal 40 is pushed into the receiving slits 32 and 23 of the insulating housing 30 and guide plate 20, respectively, such that the contact terminal is press connected to the core wire 12 within the organizing aperture 21. Then, the sheath clamp 33 of the insulating housing 30 is used to clamp the sheath 11 of the cable 10 for completing the connection between the cable and the modular plug.

The conventional modular guide plates facilitate connection of cables to modular plugs but still suffers from the following disadvantages.

After a length of sheath is removed, the core wires are separated and then inserted into the organizing apertures of the guide plate so that sometimes it is difficult to insert the core wires into the organizing apertures.

In addition, as shown in FIG. 7, there are the flexible core wires 12 between the guide plate 20 and the sheath end 11A of the cable 10 so that it is frequent that the connection end of the cable 10 is not inserted until the end of the receiving cavity 31 of the insulating housing 30. If a contact terminal 40 is press-connected when the guide plate 20 is not put into the insulating housing 30 at the predetermined position, the press connection section of the contact terminal 40 is not inserted into the receiving slit 23 but abutted against the upper wall of the guide plate 20, thus preventing press connection.

If the receiving cavity 31 of the housing 30 is enlarged so as to facilitate insertion of the connection terminal of the cable 10, the guide plate 20 is not positioned correctly because of the presence of a gap so that the contact terminal 40 is not press-connected correctly.

As shown in FIG. 8, the receiving cavity 31 of the housing 30 is made sufficiently high to receive the sheath 11 of the cable 10, but the height of the deep section 31A for receiving the guide plate 20 is small or substantially equal to the height of the guide plate 20. Consequently, there is a step-down wall 31B between the deep section 31A and the entrance section of the receiving cavity 31. This raises the following problems. When the guide plate 20 and the connection end of the cable 10 is inserted into the receiving cavity 31 of the housing 30, the guide plate 20 tends to float because of the high ceiling of the receiving cavity 31. Consequently, the guide plate 20 hits against the step-down wall 31B and cannot enter the deep section 31A of the receiving cavity 31.

Moreover, there is no means to determine the length L between the sheath end 11A and the front end of a core wire 12 so that it is difficult to provide a predetermined frequency characteristic. For example, for use in a high frequency signal of 100 MHz, it is required to use a twisted-pair cable for connection to provide a predetermined cross-talk characteristic. However, with the conventional guide plate structure, it is so difficult to keep a predetermined length of the separated core wires that it is impossible to provide a predetermined frequency characteristic.

Furthermore, the inside diameter of the organizing aperture 21 is fixed so that the size of core wires to be inserted into the organizing apertures is fixed. Consequently, it is impossible to connect core wires of only a little different size. In other words, the conventional guide plate is not adaptable for a variety of sizes of core wires.

SUMMARY OF THE INVENTION

Accordingly, it is an object of the invention to provide a modular plug guide plate which is able to solve the above problem.

According to the invention there is provided a guide plate for a modular plug having an insulation housing with a receiving cavity, which includes an organizing section having a plurality of organizing apertures in which core wires of a cable are arranged and held closely in parallel and a plurality of terminal slits through which contact terminals are press-connected to the core wires and an introducing section extending rearwardly from the organizing section and having bottom and side walls for introducing the core wires into the organizing apertures.

According to an embodiment of the invention, the bottom wall has a rear end against which a sheath end of the cable is abutted to position the core wires.

According to another embodiment of the invention, the bottom wall is provided with introducing guides for introducing the core wires to the organizing apertures.

According to still another embodiment of the invention, the terminal slits extend to a front end of the guide plate to form a plurality of cantilevered separation walls over the organizing apertures.

According to yet another embodiment of the invention, the organizing or introducing section is provided with an introducing section having a height substantially equal to that of the introducing section of the receiving cavity. The introducing section is defined by the side walls.

BRIEF DESCRIPTION OF THE INVENTION

DESCRIPTION OF THE PREFERRED EMBODIMENT

Figure 1:
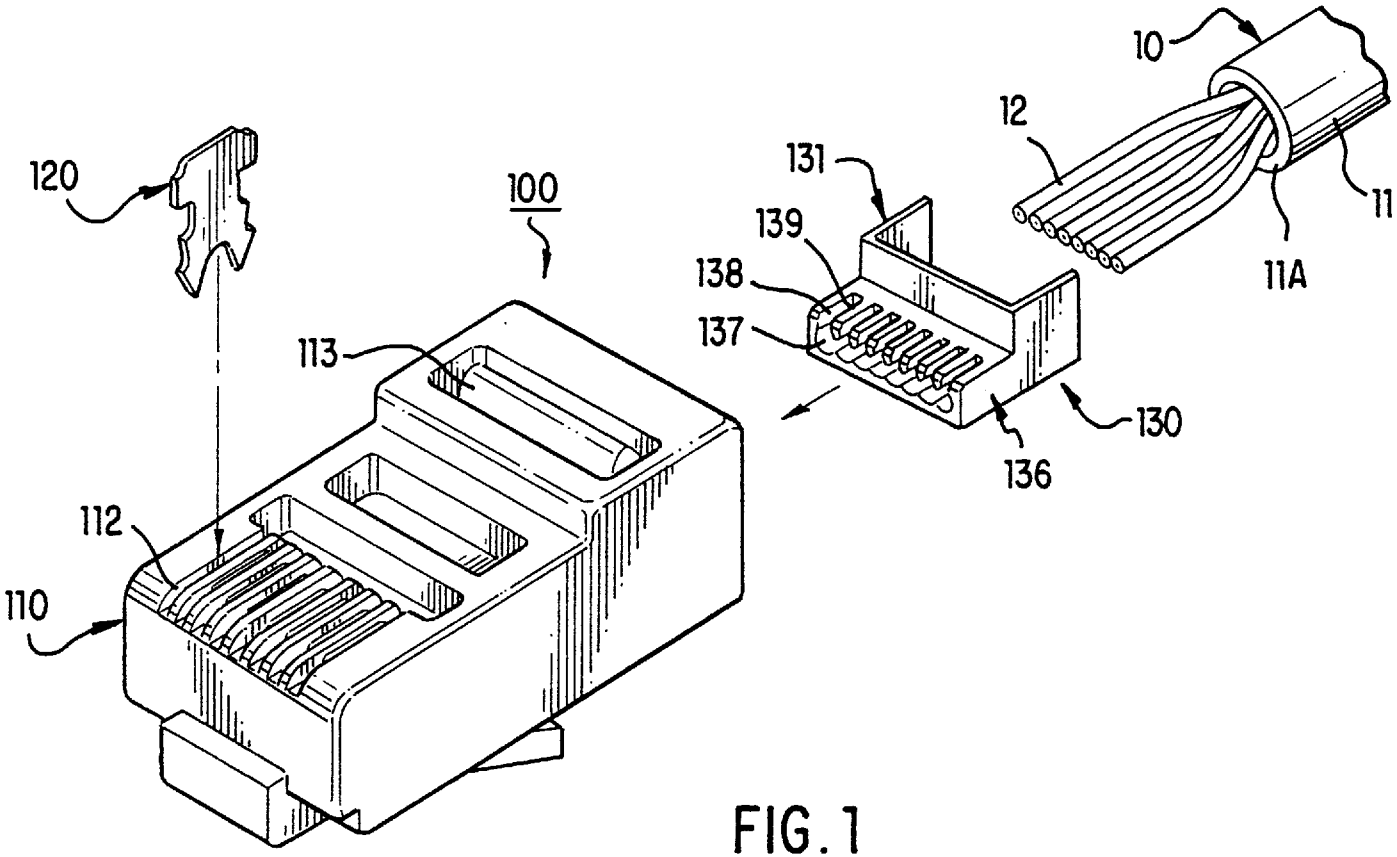
FIG. 1 is an exploded perspective view of a modular plug guide plate according to an embodiment of the invention.

In FIG. 1, a modular plug 100 includes an insulation housing 110, a number of contact terminals 120, and a guide plate 130. The insulation housing 110 and the contact terminals 120 may have conventional structures, and their description will be omitted. The guide plate 130 according to the invention is used to organize and hold core wires 12 of a round cable 10 from which a length of sheath 11 is removed to separate the core wires. It is inserted into the insulation housing 110 so that the respective contact terminals 120 are press- connected to the respective core wires 12 without difficulty.

Figure 2:
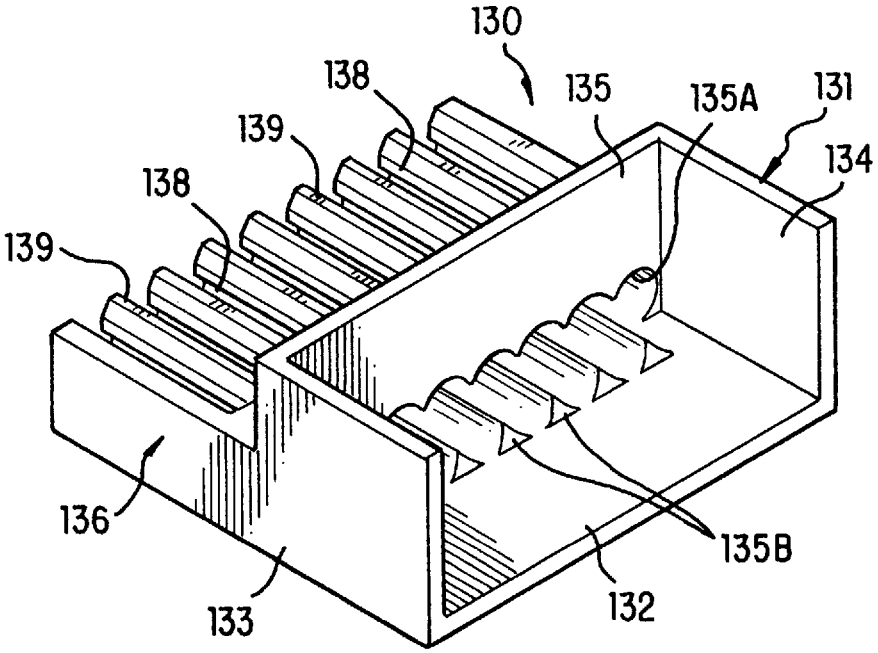
FIG. 2 is an enlarged perspective view of the guide plate viewed from the back.
Figure 5:
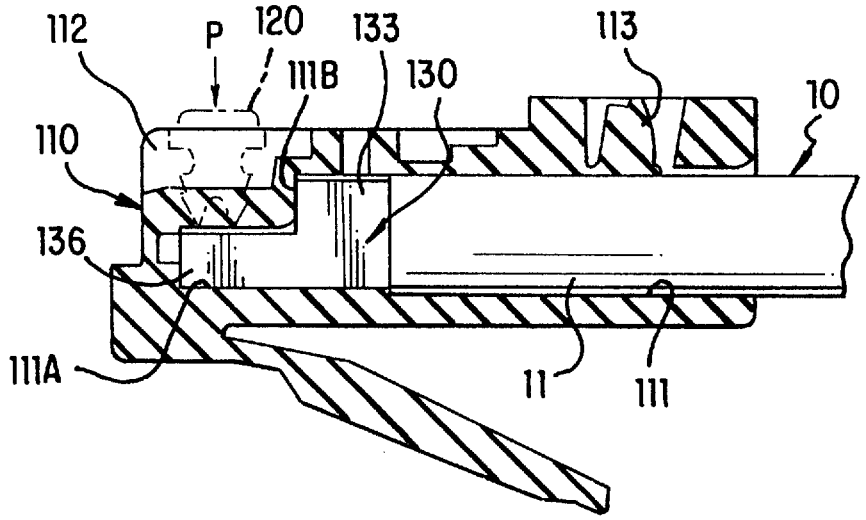
FIG. 5 is a sectional view showing how to connect a cable to a modular plug by the guide plate.
Figure 6:
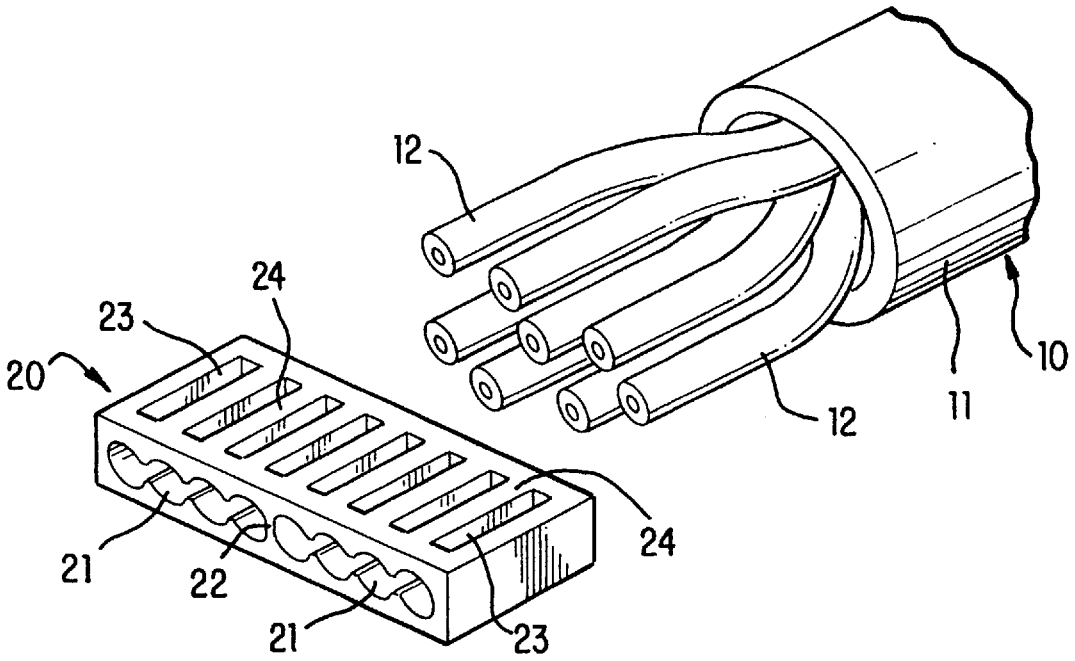
FIG. 6 PRIOR ART
FIG. 6 is a perspective view of a conventional guide plate.
Figure 7:
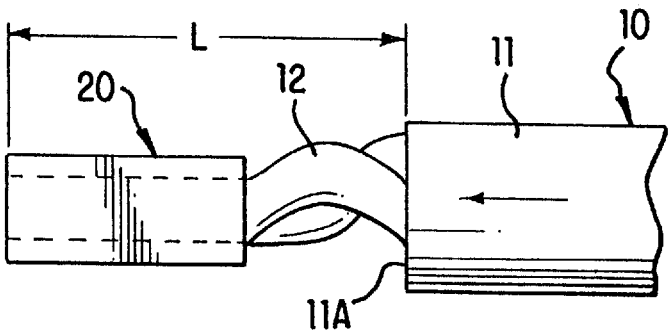
FIG. 7 PRIOR ART
FIG. 7 is a schematic diagram how to organize by the conventional guide plate.
Figure 8:
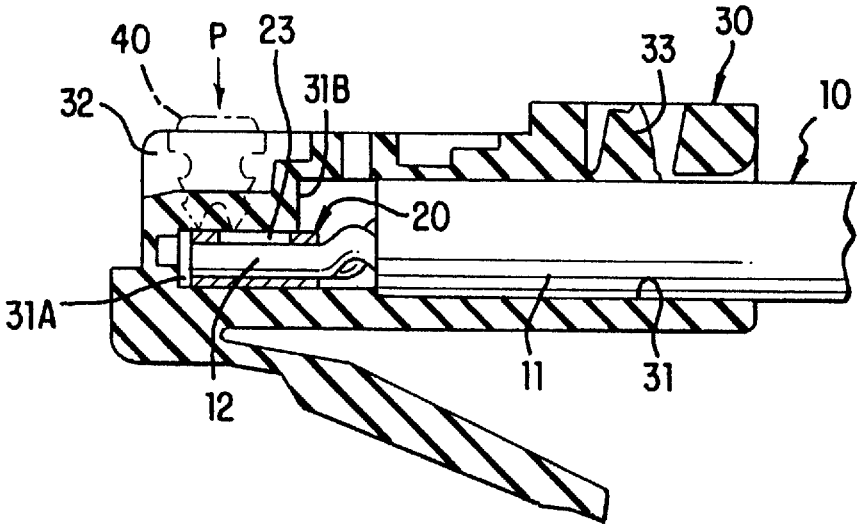
FIG. 8 PRIOR ART
FIG. 8 is a sectional view showing how to insert the organized core wires into the receiving cavity.

In FIG. 2, the guide plate 130 is molded from a transparent plastic material for example. As shown in FIG. 5, it has a shape fitted in the receiving cavity 111 of the insulation housing 110.

This guide plate includes a front organizing section 136 and a rear introducing section 131. The organizing section 136 has organizing apertures 137 for arranging and holding the core wires 12 side by side and terminal slits 138 for receiving contact terminals 120 such that the contact terminals are press connected to the corresponding core wires 12. The terminal slits 138 extend to the front ends of the organizing section 136 forming cantilevered separation walls 139.

The introducing section 131 has a bottom wall 132, side walls 133 and 134, and a front wall 135. Lower waveformed end 135A of the front wall 135 and introducing guides 135B on the bottom wall 132 form introducing spaces for the organizing apertures 137. With such a structure, the core wires 12 of the cable 10 are introduced into the organizing apertures 137 by the introducing spaces defined by the waveformed end 135A and the introducing guides 135B and organized and held closely in parallel. The sheath end 11A abuts against the rear end of the bottom wall 132 so as to position the front ends of respective core wires 12.

The height of the side walls 133 and 134 is made substantially equal to the height of the introducing section of the receiving cavity 111 so that the side walls serve as introducing sections, too. The height of the organizing section 136 is made substantially equal to the deep section 111A of the receiving cavity 111 as shown in FIG. 5. Alternatively, the introducing section may be provided on the organizing section 136.

How to use the guide plate 130 to connect a round cable 10 to a modular plug 100 will be described below. First of all, as shown in FIG. 1, a length of sheath 11 is cut and removed from the round cable 10 to expose and separate core wires 12. The length of removal of the sheath is made greater than the length L of the guide plate 130 as shown in FIG. 3.

The separated core wires 12 are organized by the guide plate 130, which is then pushed into the introducing section 131 defined by the bottom and side walls 132 and 133. The front ends of the respective core wires 12 are guided by the introducing guides 135B on the bottom wall 132 into the waveformed end 135A. As shown by an arrow in FIG. 3, the round cable 10 is pushed toward the guide plate 130 until the sheath end 11A abuts against the bottom wall 132 so that the respective core wires 12 are inserted into organizing apertures 137 of the organizing section 136, and their front ends project from the organizing apertures 137.

Figure 3:
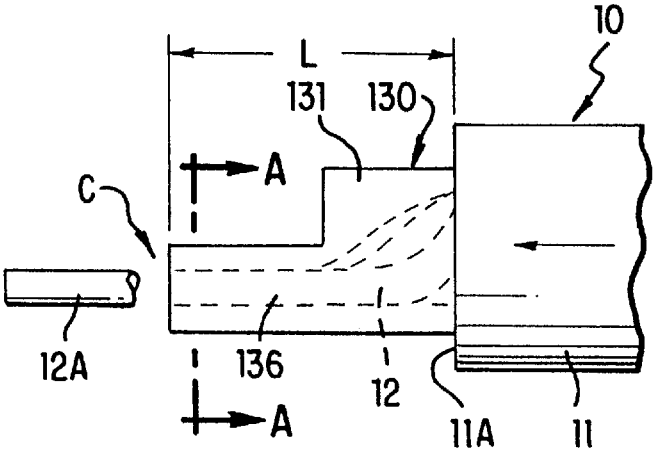
FIG. 3 is a schematic diagram showing how to organize the core wires by the guide plate.

As shown by a reference character C in FIG. 3, the front ends 12A of the respective core wires 12 are cut off so that the length of the core wires 12 from the sheath end 11A is made equal to the length L of the guide plate 130. By setting the length of the guide plate 130 at a predetermined value, it is possible to set the length of the core wires 12 from the sheath end 11A at the predetermined value.

Figure 4:
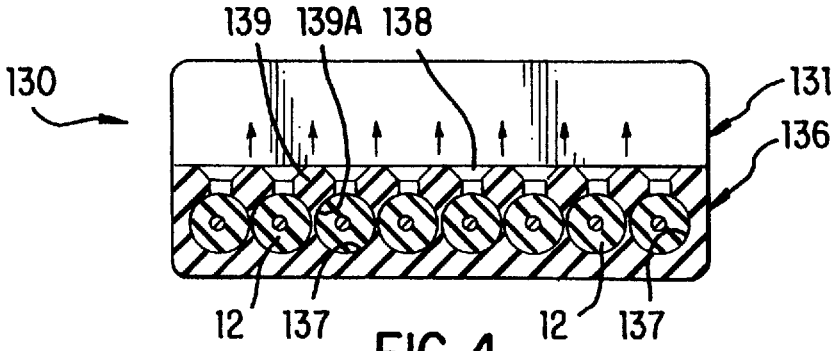
FIG. 4 is a sectional view taken along line A—A of FIG. 3.

In FIG. 4, the end portions of the respective core wires 12 are held in the organizing apertures 137 of the organizing section 136. The respective core wire 12 are held between the waveformed bottom and the lower waveformed faces of the cantilevered separation walls 139 such that the respective terminal slits 138 are aligned with the centers of the corresponding core wires 12. The separation walls 139 are flexible in a vertical direction so that when the diameters of core wires 12 are a little greater than the diameters of organizing apertures 137, the respective separation walls 139 are flexed upwardly to accommodate them.

The organized cable 10 is then inserted into the receiving cavity 111 of the insulation housing 110. Since the height of the side walls 133 and 134 is substantially equal to the height of the receiving cavity 111 of the insulation housing 110, the guide plate 130 slides into the receiving cavity 111 so that the organizing section 136 of the guide plate 130 is placed in the deep section 111A of the receiving cavity 111 without difficulty (FIG. 5). At this point, the side walls 133 and 134 abut against the step-down wall 111B between the deep section 111A and the introducing section of the receiving cavity 111 so as to serve as a stopper for positioning. The terminal slits 112 of the insulation housing 110 are aligned with the terminal slits 138 of the guide plate 130 so that it is possible to push down contact terminals 120 through the terminal slits 112 to press-connect the contact terminal to the core wires 12. The sheath clamp 113 is then pressed down to clamp the round cable 10.

The separated core wires of a cable are organized and held in the guide plate which has an organizing section and an introducing section so that the organizing operation is simplified and the connection operation of the cable to the modular plug is simplified.

The sheath end of a cable abuts against the end of the guide plate so that it is possible to place the guide plate in the deep section of the receiving cavity, assuring the press-connection of contact terminals.

By setting the length of the guide plate at a predetermined value, it is possible to set the length of core wires from the sheath end at the predetermined value, enabling to provide a predetermined cross-talk characteristic and other high frequency characteristics.

Since the separation walls are cantilevered and flexible, the core wires thicker than the standard are accommodated so that the guide plate is useful for core wires of different sizes. Since the terminal slits extend through the front end of the guide plate, if the guide plate is placed short of the deep section of the receiving cavity, it is still possible to press connect contact terminals to the core wires because the contact terminals are not blocked by the terminal slits of the guide plate.

The organizing and introducing sections have different shapes so that it is prevented to insert the guide plate into the insulation housing upside down.

What is claimed is:

1. A modular plug comprising: an insulation housing with a mating end section having a plurality of first terminal slits and a receiving cavity extending rearwardly from said mating end section, a guide plate fitted in a front portion of said receiving cavity, said guide plate comprising:

an organizing section having a plurality of organizing apertures in which core wires of a cable are arranged and held closely in parallel and a plurality of second terminal slits through which contact terminals are press-connected to said core wires via said first terminal slits and an introducing section extending rearwardly from said organizing section and having front, bottom and side walls for defining an introducing cavity for introducing said core wires into said organizing apertures, said bottom wall having a rear end against which an end of sheath of a cable is abutted to determine a length of said core wires from said end of sheath and accommodate a portion of said cable in a rear portion of said receiving cavity thereby enhancing high-frequency characteristics, said bottom wall of said introducing section and a bottom wall of said second terminal slits of said organizing section are substantially in a same flat plane.

2. A modular plug according to claim 1, wherein said bottom wall is provided with introducing guides for introducing said core wires to said organizing apertures.

3. A modular plug according to claim 2, wherein said introducing section is provided with an introducing staces having a height substantially equal to that of said organizing section.

4. A modular plug according to claim 3, wherein said introducing spaces are defined by waveformed end of said front wall and said introducing guides on said bottom wall.

5. A modular plug comprising:

an insulation housing with a mating end section having a plurality of first terminal slits and a receiving cavity extending rearwardly from said mating end section, a guide plate fitted in a front portion of said receiving cavity, said guide plate comprising:

an organizing section having a plurality of organizing apertures in which core wires of a cable are arranged and held closely in parallel and a plurality of second terminal slits through which contact terminals are press-connected to said core wires via said first terminal slits and an introducing section extending rearwardly from said organizing section and having front, bottom and side walls for defining an introducing cavity for introducing the core wires into said organizing apertures, said bottom wall having a rear end against which an end of sheath of a cable is abutted to determined a length of said core wires from said end of sheath and accommodate a portion of said cable in a rear portion of said receiving cavity thereby enhancing high-frequency characteristics, wherein said second terminal slits extend to a front end of said guide plate to form a plurality of cantilevered separation walls which extend forwardly from said front wall of said guide plate over said organizing apertures, said cantilevered separation walls being vertically flexible so as to accommodate core wires of a variety of diameters.

* * * * *